United States Patent [19]

Kley

[11] 4,109,118

[45] Aug. 22, 1978

[54] KEYSWITCH PAD

[76] Inventor: Victor Kley, 2212 Byron St., Berkeley, Calif. 94702

[21] Appl. No.: 719,408

[22] Filed: Sep. 1, 1976

[51] Int. Cl.[2] ..... H01H 9/20; H01H 13/50

[52] U.S. Cl. ..... 200/5 E; 200/5 R; 200/83 B; 200/159 R; 200/302; 200/314; 340/365 A

[58] Field of Search ..... 200/1 R, 5 R, 5 A, 5 F, 200/83 B, 294, 159 R, 302, 314, 83 N; 197/98; 340/365 A; 235/145 R

[56] References Cited

U.S. PATENT DOCUMENTS

| | | | |
|---|---|---|---|
| 2,800,034 | 7/1957 | Seeger | 200/5 R X |
| 3,268,673 | 8/1966 | Bilek | 200/83 B X |
| 3,304,386 | 2/1967 | Shlesinger, Jr. | 200/83 B X |
| 3,805,939 | 4/1974 | Ross | 197/98 X |
| 3,846,596 | 11/1974 | Wolf | 200/294 |
| 3,911,233 | 10/1975 | Nakumura et al. | 200/5 R |
| 4,032,728 | 6/1977 | Oelsch | 200/5 A |

OTHER PUBLICATIONS

Cook, S. D., et al.; IBM Tech. Disc. Bull,; Key Matrix Using a Fluid Medium; vol. 13, No. 3, Aug. 1970; p. 744.

Easton, R. C.; IBM Tech. Disc. Bull.; Hydraulically Controlled Keyboard Interlock Mechanism; vol. 14, No. 8, Jan. 1972, p. 2540.

*Primary Examiner*—James R. Scott

*Attorney, Agent, or Firm*—O'Brien and Marks

[57] ABSTRACT

The keyswitch pad includes a plurality of keyswitches on a common backing member, each of the keyswitches including a fluid filled bag underneath a key cap. The bags of the keyswitches are interconnected and the system of bags is closed so as to be of limited volume so that only one keyswitch at a time can be depressed. Several different types of keyswitches can be used in any one switch pad and several types of switching, latching, and display mechanisms are disclosed for the keyswitches.

38 Claims, 28 Drawing Figures

FIG. 3
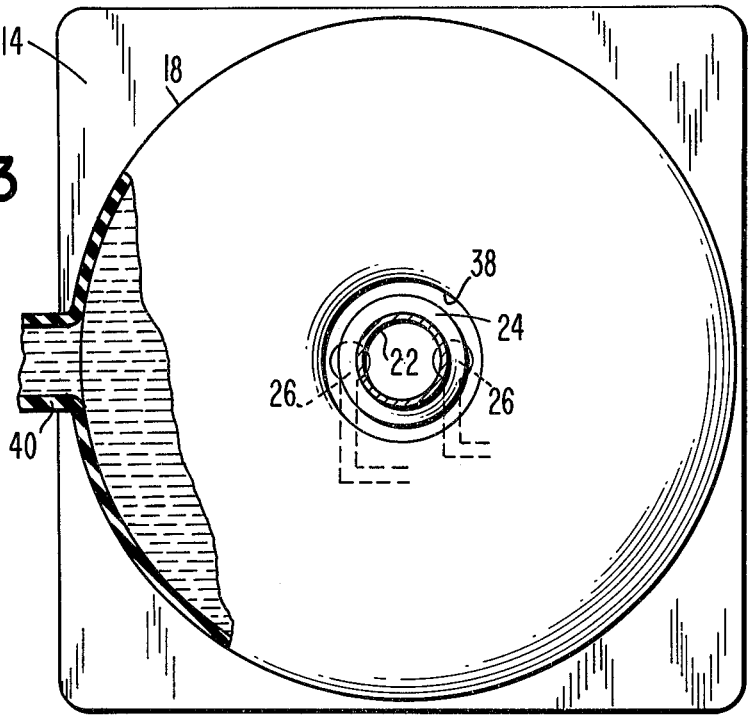
FIG. 4
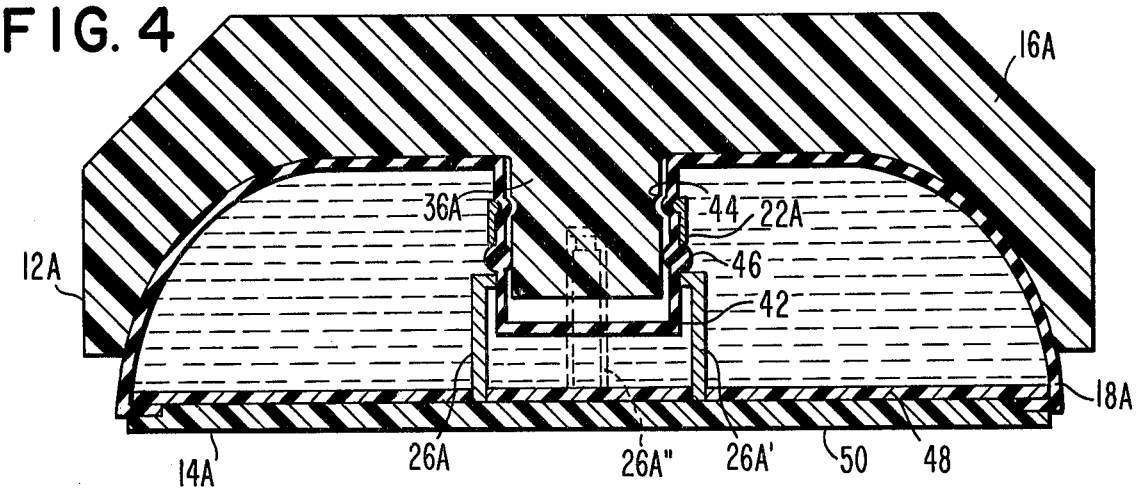
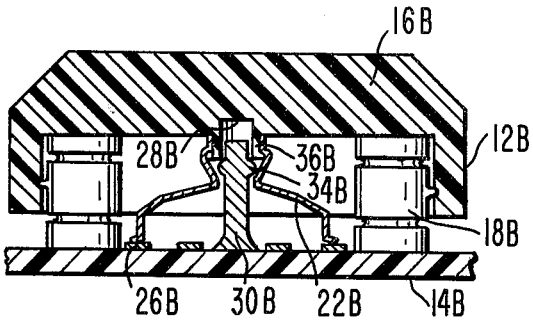
FIG. 5
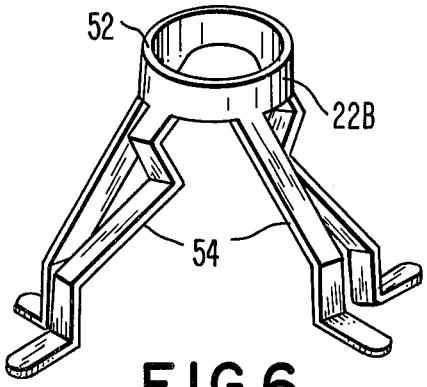
FIG. 6

FIG.11
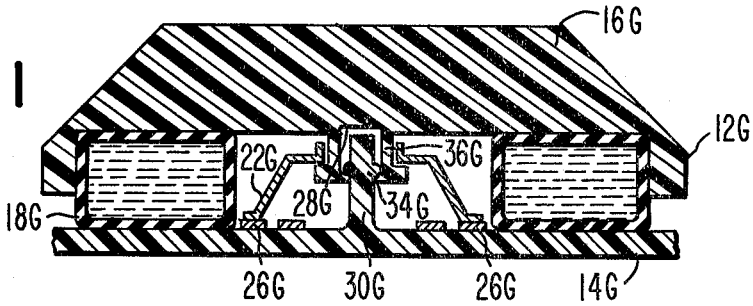
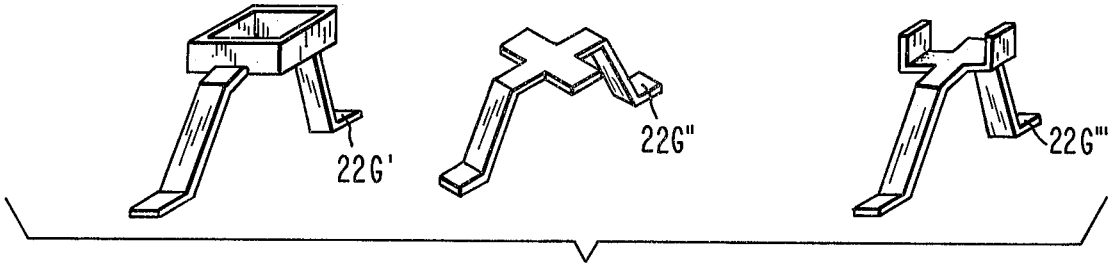
FIG.12
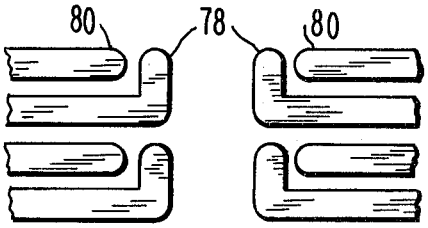
FIG.13
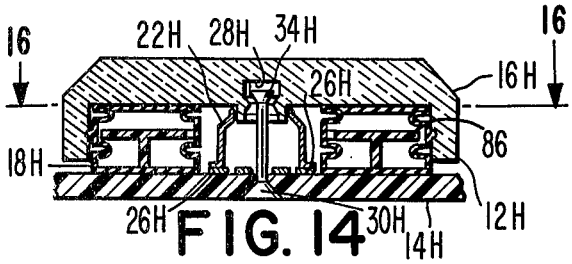
FIG. 14
FIG.16
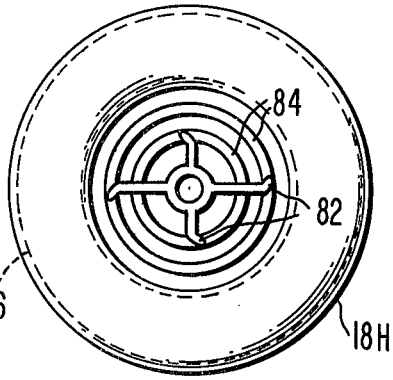
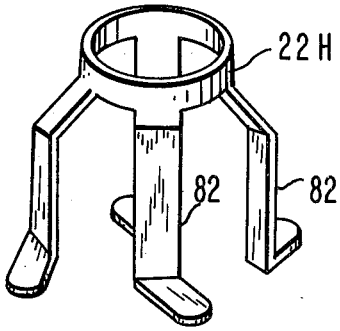
FIG. 15
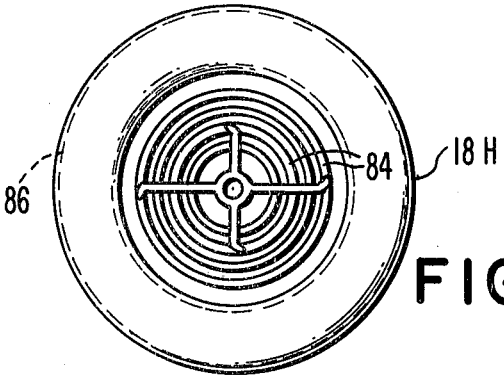
FIG. 17

KEYSWITCH PAD

BACKGROUND OF THE INVENTION

1. Field of the Invention

The invention relates to manually operable keyswitches in general, and in particular to pads, rows or banks of such keyswitches wherein the individual keyswitches are interlocked or interconnected so that only one keyswitch at a time is actuable.

2. Description of the Prior Art

It has long been the practice in the prior art to interconnect keyswitches in a pad or bank by providing complex mechanical interlocks between the keyswitches so that all are released when one keyswitch is depressed. These arrangements have suffered from problems of complexity, unreliability and high cost.

It has been proposed in at least two instances to interconnect switching or switch-like functions by a fluid filled receptacle. U.S. Pat. No. 2,800,034 describes a mechanical interlock between a relay, a contactor and a solenoid that includes a hollow member filled with liquid. U.S. Pat. No. 3,268,673 discloses a hydraulic pushbutton assembly in which a plurality of pushbuttons press on a common fluid filled bag.

SUMMARY OF THE INVENTION

The present invention is summarized in that a keyswitch includes a backing member, a key cap spaced from but movable toward the backing member, switching means arranged between the backing member and the key cap and operated by movement of the key cap, and a fluid filled bag disposed between the key cap and the backing member.

An object of the present invention is to provide a keyswitch usable in a keyswitch pad, each keyswitch including a provision for a simple and economical interlock between the keyswitches in the pad.

It is another object of the present invention to construct a pad of such keyswitches, the keyswitches in the pad having diverse types of switching mechanisms so that a highly customized keyswitch pad can be easily constructed.

It is yet another object of the present invention to construct such a pad of keyswitches wherein some or all of the keyswitches may include latching mechanisms and/or optical indicating devices to display the switching state of the keyswitches.

Still more objects, advantages and features of the present invention will become apparent from the following specification when taken in conjunction with the accompanying drawings.

BRIEF DESCRIPTION OF THE DRAWINGS

FIG. 3 is a top view of th right hand keyswitch of FIG. 2 with the cap removed and part of the bag broken away.

FIG. 4 is a cross section similar to FIG. 2 of an alternative embodiment of a keyswitch according to the present invention.

FIG. 5 is a cross section similar to FIG. 4 of another alternative embodiment of the present invention.

FIG. 6 is a perspective view of the upper switch half of the keyswitch of FIG. 5.

FIG. 11 is a cross section similar to FIG. 4 of another alternative embodiment of the present invention.

FIG. 12 is a perspective view of three embodiments of the upper switch half of FIG. 11.

FIG. 13 is a top plan view of the arrangement of the printed circuit runs of the lower switch half of FIG. 11.

FIG. 14 is a cross section similar to FIG. 4 of still another alternative embodiment of the present invention.

FIG. 15 is a perspective view of the upper switch half of FIG. 14.

FIG. 16 is a cross section along the line 16—16 in FIG. 14.

FIG. 17 is a cross section similar to FIG. 16 of an alternate configuration of the embodiment of FIG. 14.

DESCRIPTION OF THE PREFERRED EMBODIMENT

Figure 1:
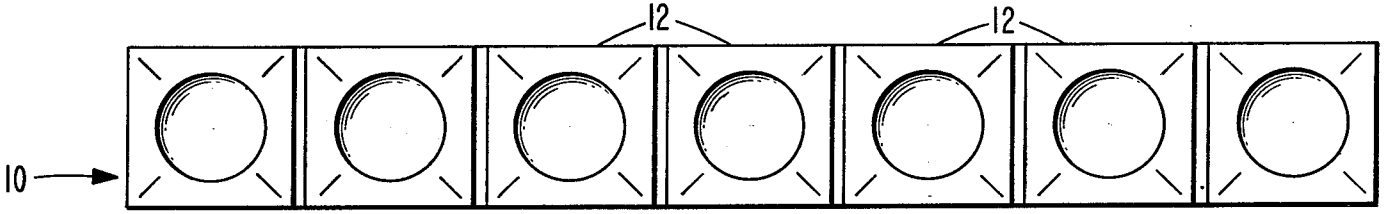
FIG. 1 is a top plan view of a keyswitch pad constructed according to the present invention.

Shown in FIG. 1 is a multiple-key keyswitch pad, generally incicated at 10, including a plurality of manually operable keyswitches 12 all constructed according to various embodiments of the present invention. The pad 10 may be mounted on the face of any suitable electronic or electrically controlled device which requires the manual selection of control or data information.

Figure 2:
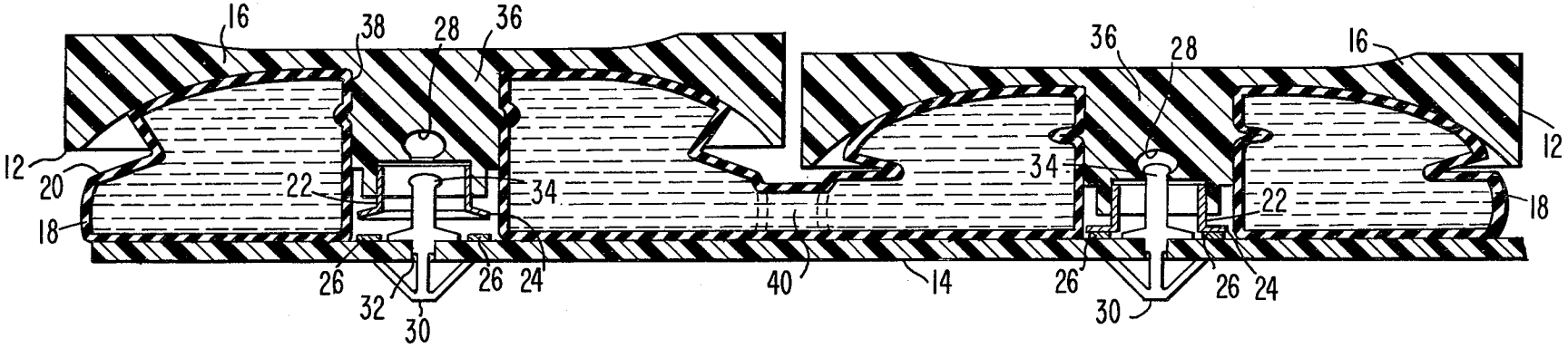
FIG. 2 is a vertical cross section taken through the two keyswitches at the left of the pad of FIG. 1.

A cross section through an adjacent identical pair of the keyswitches 12 in the pad 10 is shown in FIG. 2. Each of the keyswitches 12 is mounted on a common backing member 14, which is preferably, in this embodiment, a conventional plastic printed circuit board. A key cap 16 forms the top of each of the keyswitches 12, the cap 16 being of any appropriate color and design as may be desired for any particular application and being embossed with any indicia as may be needed to indicate the nature of each of the keyswitches 12. Between the cap 16 and the backing member 14 in each keyswitch 12 is a fluid filled bag 18 filled with an incompressible fluid such as water or other suitable liquid. The bag 18 has a fold 20 formed in it just under the cap 16. Extending downward from the center of the underside of the cap 16 is a movable upper switch half 22, which in this embodiment is formed as a metallic switch contact shaped in a generally cylindrical form with an outturned annular lip 24 formed at its lower edge. Provided on the backing member 14 is a stationary lower switch half 26, which in this embodiment is a pair of switch contact members formed by plated conductive strips on the printed circuit board of the backing member 14, as can be seen in dotted lines in FIG. 3. The cap 16 has provided in it an upper latching member 28 in the form of a latching recess provided in the lower part of the cap 16, the latching recess 28 being generally rounded with a restricted opening through the bottom surface of the cap 16. A lower latching member 30 is in this embodiment formed as a latching projection or stake which is staked through a hole 32 in the backing member 14. The latching member 30 has formed at its upper end a latching mechanism 34 in the form of an enlarged bulb. The moveable switch half 22 and the latching recess 28 are formed on a downwardly extending stem portion 36 of the cap 16. The stem portion 36 of the cap 16 is received within a cylindrical hole 38 provided through the center of the bag 18, which is of generally annular shape as can be seen in FIG. 3. A coupling tube 40 is provided between each of the bags 18 of adjacent ones of the keyswitches 12 in the keyswitch pad 10. The bags 18 of all the keyswitches 12 are therefore all in fluid communication with each other, the end bags 18 being sealed so that the whole system of bags 18 is closed to the atmosphere. Thus, if the two keyswitches 12 of FIG. 2 were the two keyswitches at the extreme left edge of the pad 10 of FIG. 1, the right hand keyswitch 12 of FIG. 2 would have an additional coupling tube 40 provided at its right extreme edge to connect it to the next keyswitch to the right in the pad 10.

In the operation of either of the keyswitches 12 of FIG. 2, the keyswitch is operated by pressing on the cap 16. The cap 16 then moves toward the backing member 14 until the locking recess 28, locks over the locking bulbs 34 latching the cap 16 in place and providing tactile feedback to the switch operator. The right keyswitch 12 in FIG. 2 is shown in the latched or closed position. When the keyswitch 12 is closed, the lip 24 of the switch half 22 contacts both parts of the switch half 26 thereby making an electrical circuit therebetween to close the switch.

As any one of the keyswitches 12 is closed, the bag 18 of that keyswitch contracts forcing the fluid out under pressure through the coupling tube 40. This fluid under pressure will cause any of the other keyswitches 12 which are depressed to experience a rise in fluid pressure in their bags 18, ultimately causing the latching mechanisms in those switches to disengage to release the switch. Thus if the right hand keyswitch 12 in FIG. 2 is closed, as shown in FIG. 2, and the lefthand keyswitch 12 was depressed, the righthand keyswitch 12 would be de-latched by that operation.

Thus with a plurality of keyswitches 12 similar to those in FIG. 2 it would be possible to construct a pad 10 of keyswitches in which all the keyswitches are interlocked so that depression of any one causes release of all others. Thus interlocking is accomplished with no mechanical interconnection between the switches, other than the coupling tubes 40, and is accomplished in keyswitches in which all of the parts are relatively simple and economical to construct. As desired the fluid in the bags 18 could be either insulating, if so required, or could be conductive so that a shield would surround each switch to prevent electrical interference between them.

Other variations in cap design, switch type, and latching mechanism are possible beside those shown in the keyswitches 12 of FIG. 2. Some possible variations of these and other features are shown in FIGS. 4–28. In each of these embodiments, the various elements which are common to each embodiment retain the same reference numerals as those elements had in FIG. 2, with a letter suffix added to distinguish between the embodiments. Each of the keyswitches shown in any of these embodiments could be combined with any other of these keyswitches in a common pad 10, with the bags 18 of adjacent keyswitches being interconnected by coupling tubes 40. The coupling tubes 40 have been omitted from the drawings of most of the embodiments, but are assumed to be present in all of them. In this way a very large number of switch pad configurations are possible and each pad 10 can be customized for the particular application.

The keyswitch 12A shown in FIG. 4 uses the lower switch half 26A for the latching mechanism. The bag 18A is rounded with a central cup-shaped portion 42 which is formed around the stem portion 36A of the cap 16A. The upper movable switch half 22A is formed as a metallic ring clamping the cup-shaped portion 42 of the bag 18A onto a circular groove 44 in the stem portion 36A so that it moves therewith. A circular retaining bump 46 is formed in the cup-shaped portion 42 of the bag 18A. The edges of the bags 18A are pinned between the backing member 14A and a substrate layer 48. The lower stationary switch half 26A includes a pair of lower contact posts 26A' and a pair of upper contact posts 26A" each of the contact posts 26A' and 26A" being conductive and having a perpendicular bend at its top. The fluid in the bag 18A of the keyswitch 12A is therefore of a non-conductive character. The rear of the backing member 14A has a layer of adhesive 50 applied thereto.

The keyswitch 12A of FIG. 4 operates as a latching switch due to the action of the contact posts 26A' which latch over the retaining bump 46 when the cap 16A is depressed. The switch half 22A causes the cup shaped portion 42 of the bag 18A to follow the movement of the cap 16A and also makes a connection between the contact posts 26A" when the switch is not depressed, and makes contact between the contact posts 26A' when the switch is depressed. Thus the keyswitch 12A has both normally open (26A') and normally closed (26A") contacts. The contact posts 26A' and 26A" may connect to printed circuit foil conductors on either side of the substrate layer 48.

The adhesive layer 50 allows the keyswitch 12A to be applied to the front panel of any device, thereby securing the switch in place and requiring only electrical connection to complete the assembly. The adhesive layer is positioned on the back of the backing member 14 which is preferably common to all the keyswitches in the pad 10, so that the entire pad 10 can be easily installed.

In FIG. 5, a keyswitch 12B is shown that utilizes the upper switch half 22B for the latching means. The upper switch half 22B, also shown in FIG. 6, has a ring shaped portion 52, and two oppositely extending pairs of legs 54, with the ring shaped portion 52 being received on the stem portion 36B. One, or possibly both, of the pairs of legs 54 has an inward bend formed in it just beneath the ring shaped portion 52. The lower switch half 26B includes inner contacts and outer contacts both formed as plated conductive runs on the backing member 14B. The latching member 30B has formed on it the latching mechanism 34B in the form of an annular rib around the latching member 30B.

In its operation, the keyswitch 12B connects the inner set of contacts on the switch half 26 to the outer set through the upper switch half 22B. When depressed the inwardly bent sections of the bent pair of legs 54 snap over the latching mechanism 34B to latch the switch. If desired the legs 43 could be constructed of bimetallic or some other temperature dependent material so that the legs 54 would flex in response to temperature due to current so that the keyswitch 12B could act as a current-limiting circuit breaker, releasing when the current through the keyswitch becomes excessive.

Figure 7:
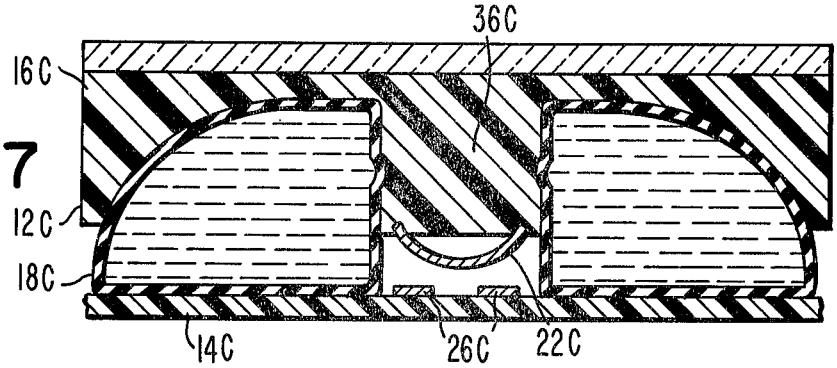
FIG. 7 is a cross section similar to FIG. 4 of yet another alternative embodiment of the present invention.

FIG. 7 shows an embodiment of the present invention in which a keyswitch 12C is non-latching. The upper switch half 22C is a metallic sheet staked into the stem portion 36C of the cap 16C, and the lower switch half 26C is again formed as a pair of printed circuit conductors.

In the operation of the keyswitch 12C, depression of the cap 16C causes the switch half 22C to touch the switch half 26C to create a circuit path, and to delatch any adjacent keyswitches 12 which are of a latching variety. When the pressure on the cap 16C is released, the natural resiliency of the bag 18C returns the cap 16C to its position as shown in FIG. 7.

Figure 8:
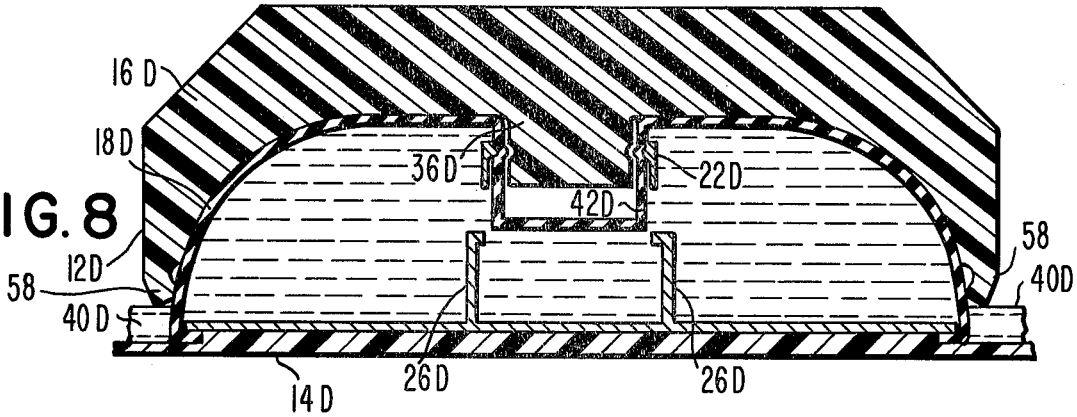
FIG. 8 is a cross section similar to FIG. 4 of still another alternative embodiment of the present invention.

In the embodiment of FIG. 8, a keyswitch 12D includes the bag 18D which is again provided with a cup-shaped portion 42D similar to FIG. 4. The cup shaped portion 42D is secured to the stem portion 36D of the cap 16D by the upper switch half 22D formed in the shape of a ring clamping the cup-shaped portion 42D to the stem portion 36D of the cap 18D. In this embodiment a lower switch half 26D includes only two sets of vertical contact posts. At opposite edges of the cap 16D, directly above the coupling tubes 40D, decoupling gates 58 are provided on the cap 16D. The decoupling gates 58 are downwardly turned extensions of the cap 16D that have a hollow formed on their interior surfaces to add flexibility to their construction.

In its operation, the keyswitch 12D of FIG. 8 operates as a momentary switch. When the cap 16D is depressed, the ring switch half 22D contacts both of the contact posts on the lower switch half 26D to make electrical contact therebetween. When the cap 16D is released, it is returned upward by the natural resiliency of the bag 18D to break the contact. The decoupling gates 58 serve to decouple the keyswitch 12D from adjacent keyswitches formed in a pad 10. As the cap 16D is depressed, the decoupling gates 58 press down upon and pinch off the coupling tubes 40D. The fluid in the bag 18D therefore cannot pass through to the neighboring keyswitches, and the neighboring keyswitches are not delatched. The bag 18D is provided with enough free space left for it underneath the cap 16D so that it can resiliently flex enough so that the contact can be made between the switch halves 22D and 26D. Decoupling gates 58 are provided on keyswitches where it is desired that a momentary or other switching function be provided on the keyswitch pad which will not serve to delatch the other keyswitches in the pad 10.

Figure 9:
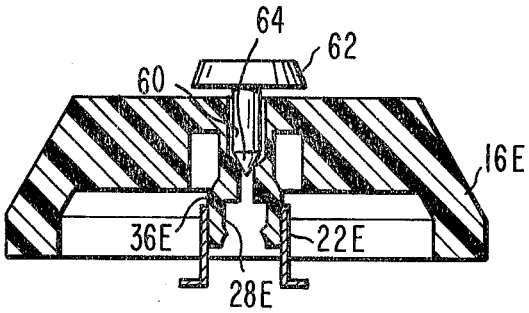
FIG. 9 is a vertical cross section through a key cap substitutable for the key cap in FIG. 2.

In the embodiment of FIG. 9, a cap 16E for a keyswitch is shown, the cap 16E being substitutable for the cap 16 in FIG. 2 to create a latch-delatch or "push-push" type of keyswitch. The cap 16E is provided with a central bore 60 which extends therethrough downward through the stem portion 36E. The latching recess 28E is defined within the stem portion 36E and is formed as a part of the central bore 60. The switch half 22E, of a type similar to that in FIG. 1, is received on the stem portion 36E. A delatch button is provided extending into the central bore 60 and terminating in a tapered point 64.

In the operation of a keyswitch including the cap 16E of FIG. 9, the cap 16E is depressed to latch the latching recess 28E over a suitable latching member provided on the backing member of the switch (such as the latching member 30 in FIG. 2). When the cap 16E is depressed, the switch half 22E then contacts the respective switch half 26 (not shown in FIG. 9) to complete the circuit. To release the keyswitch, the delatch button 62 is depressed to force the tapered point 64 of the delatch button 62 downward into the central bore 60 thereby widening the latching recess 28E and removing its hold upon the latching member. The release of the latching recess 28E allows the resiliency of the bag 18 to force the cap 16E to return to its retracted position. Of course, the keyswitch including the cap 16E could also be delatched by the operation of another adjacent keyswitch through the fluid connection provided by the coupling tubes 40 similar to the other latching keyswitches disclosed herein.

Figure 10:
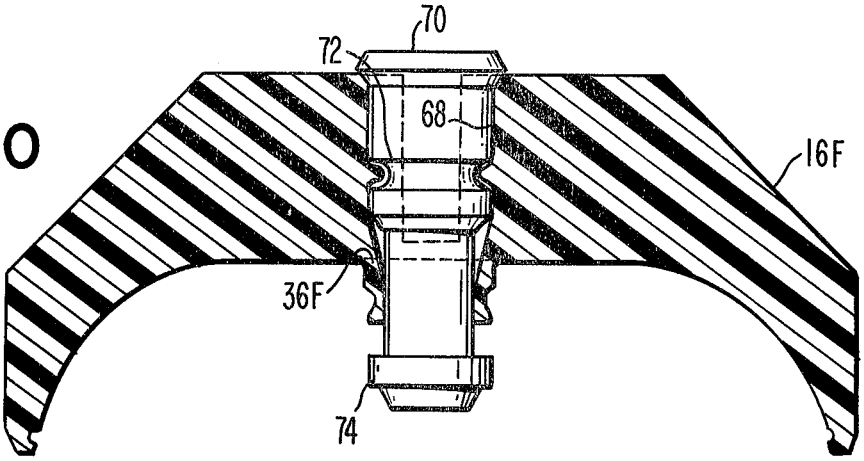
FIG. 10 is a vertical cross section through a key cap substitutable for the key cap in FIG. 4.

The embodiment of FIG. 10 shows a keyswitch cap 16F of a latch-delatch type that can be substituted for the cap 16A of FIG. 4. The stem portion 36F of the cap 16F includes an annular groove provided therearound so that the ring of the switch 22A of FIG. 4 could still be used to clamp the bag 18A to the cap 16F of FIG. 10. The cap 16F is divided into two equal halves by a central left 68 which receives therein a latch button 70. The latch button 70 has an annular groove 72 formed in it and the cap 16F has a raised annular rib formed inside of the central cleft 68 and shown engaging the annular groove 72 in FIG. 10. A retaining skirt 74 is provided extending outward from the bottom end of delatch button 70.

The cap 16F of FIG. 10 operates as a latch-delatch or "push-push" switch in a manner slightly different from the cap 16E of FIG. 9. To operate the key cap 16F the latch button 70 is depressed thereby latching lower switch half 26A over the pertuberances provided in the bag 18A as shown in FIG. 4. The latch button 70 of the cap 16F is shown in FIG. 10 in its latched or depressed position. To delatch the keyswitch including the cap 16F, the sides of the cap 16F are depressed. Depression of the sides of the cap 16F slightly widens the central cleft 68 of the cap 16F thereby allowing the latch button 70 to be raised vertically to delatch the keyswitch. Of course, similarly to FIG. 9, the keyswitch including the cap 16F can also be delatched by depression of an adjacent keyswitch.

Shown in FIG. 11 is a keyswitch 12G including a provision for multiple pole switching. The upper switch half 22G, which depends from the stem portion 36G of the cap 16G, is formed so as to include two electrically connected dependent switch arms which may be connected in any of a variety of manners. Shown in FIG. 12 are three upper switch halves, 22G', 22G'' and 22G''', any or all of which may be used in any single embodiment of the switch 12G. Through the use of more than one of the upper switch halves 22G, the multiple pole switching of the keyswitch 12G is obtained. Shown in FIG. 13 is the arrangement of the printed circuit conductive runs of lower switch half 26G which allows the use of the upper switch half 22G. Each set of the lower switch halves 26G includes a set of inner contacts 78 and a pair of outer contacts 80. There are as many sets of contacts as there are upper switch halves 22G.

In the operation of the keyswitch 12G the latching mechanism 34G latches into the latching recess 28G in the manner as illustrated in FIG. 11, in which the keyswitch 12G is shown as closed. When the keyswitch 12G is open, the depending switch arms of the upper switch halves 22G spring inwardly to contact the inner set of contacts 78 of the lower switch half 26G. When the switch is closed, as shown in FIG. 11, the switch arms are forced apart to contact the outer pair of contacts 80 of the lower switch half 26G. Thus in the embodiment of FIG. 11 a keyswitch 12G is provided that includes both multiple pole and multiple throw switching.

In FIG. 14 a keyswitch 12H is illustrated which includes an optical indication of the state of the switch. The keyswitch 12H includes the cap 16H which in this embodiment is made of an optically transparent, translucent or other light-transmissive material. The stem portion 36H of the cap 16F includes the locking recess 28H adapted to receive the latching mechanism 34H on the latching member 30H. The fluid filled bag 18H is received between the cap 16H and the backing member 14H. The upper switch half 22H includes a ring shaped portion surrounding the stem portion 36H and a plurality of inwardly biased spring switch arms 82 which depend therefrom. The lower switch half 26H includes a pair of concentric annular contact rings 84 formed as printed circuit clad elements on the backing member 14H. As shown in FIG. 15 the end of each of the dependent spring loaded switch arms 82 of the upper switch half 22H is provided with a bent contact portion. Each of the bent contact portions of the switch arms 82 is bent at an angle as can be seen in FIGS. 15 and 16. The keyswitch 12H also includes an annular upraised contrast plate 86 located within the bag 18H. The fluid within the bag 18H in this embodiment is preferably of a dimly translucent, or preferably semi-opaque liquid. The bag 18H itself is also to be formed out of a transparent or translucent material.

As can be seen in FIG. 16, in the operation of the keyswitch 12H the upper switch half 22H serves to make contact between the two concentric annular rings 84 of the lower switch half 28H when the keyswitch 12H is latched in its closed position as is shown in FIG. 14. The bent contact portions at the ends of the switch arms 82 served to rub against the contact rings 84 of the lower switch half 26H so as to slightly turn the upper switch half 22H in a circular manner during each depression of the keyswitch 12H. In this manner, the upper switch half 22H constantly revolves around the stem portion 36H so that no single portion of the rings 84 is worn excessively more than any other portion. The contrast plate 86 functions to provide an optical indication as to the state of operation of the keyswitch 12H. When the keyswitch 12H is open, or not depressed, the dark or semi-opaque character of the fluid in the bags 18H hides the contrast plate 86 from view. When the keyswitch 12H is depressed, the contrast plate 86 can be seen through the key cap 16H, the top surface of the bag 18H and the small amount of liquid left between the contrast plate 86 and the top of the bag 18H. The visibility of the contrast plate 86 can be adjusted by adjusting the height at which the contrast plate 86 is mounted above the backing plate 14H, and by adjusting the opaqueness of the fluid within the bag 18H. In this manner an optical indication of the state of the keyswitch 12H is obtained without the necessity of any energy output or any additional moving parts.

Shown in FIG. 17 is a variation on the switch of FIGS. 14 through 16 in which the switch is constructed to be double throw rather than single throw. Each of the concentric rings of the lower switch half 26H is provided with an inner ring and an outer ring. In this manner each of the spring loaded dependent switch arms 82 of the upper switch half 22H contacts an inner ring when the keyswitch 12H is delatched, and contacts an outer ring when the keyswitch 12H is depressed or latched, thus performing double throw switching.

Figure 18:
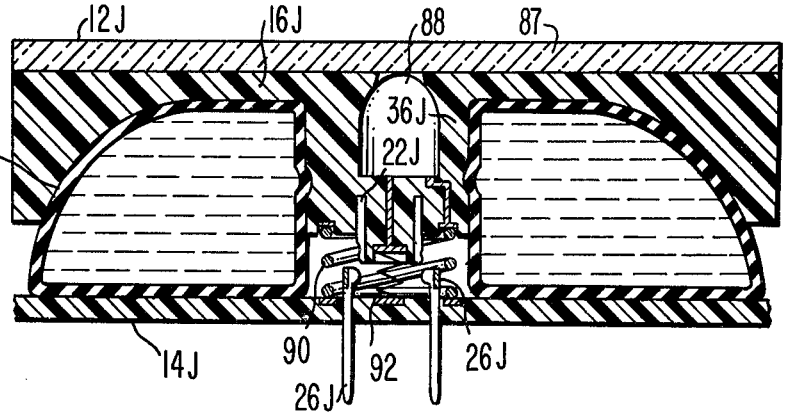
FIG. 18 is a cross section similar to FIG. 4 of yet another alternative embodiment of the present invention.

Shown in FIG. 18 is a keyswitch 12J which includes a provision for an optical indication of the switching state of the keyswitch. The cap 16J of the keyswitch 12J includes a transparent top cover 87 under which is mounted a light-emitting diode (LED) 88. Each of the two terminals of the LED 88 is connected to a plated conductive run on the printed circuit board of the backing member 14J by a respective one of two springs 90 and 92 which also serve to further bias the cap 16J upward. The upper switch half 22J is formed as a conductive cylinder with an annular groove formed near its lower edge, and a pair of staked posts form the lower switch half 26J, with each of the posts having an inward projection at its upper end.

In its operation, the projections at the upper end of the staked posts of the lower switch half 26J snap into the annular groove in the upper switch half 22J to latch the keyswitch 12J in its depressed position. The LED 88 is lit by the external circuitry through the springs 90 and 92 when the keyswitch 12J is latched.

Figure 19:
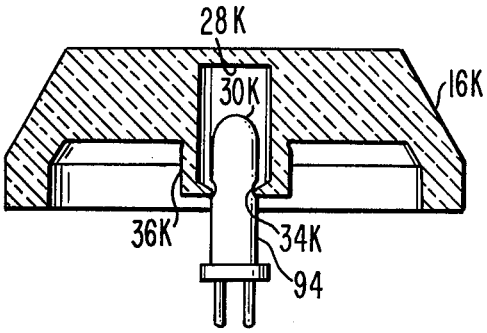
FIG. 19 is a cross section similar to FIG. 4 of a key cap and a latching member of still another alternative embodiment of the present invention.

A keyswitch cap 16K and a latching member 30K are shown in FIG. 19 that can be substituted for similar components in several of the above embodiments, as for example in FIG. 2. The latching member 30K is formed by a light-emitting diode (LED) 94 with the latching mechanism 34K being formed in it in the form of an annular groove. The stem portion 36K of the cap 16K is formed with the latching recess 28K to receive the top of the LED 94, and the entire cap 16K is here formed of optically transparent or light transmissive material.

In the operation of a keyswitch including the cap 16K of FIG. 19, the stem portion 36K of the cap 16K snaps into the groove of the latching mechanism 34K on the LED 94 to latch the cap 16K in position. The LED 94 is lit by the external circuitry to indicate that the keyswitch either has, or has not, been depressed.

Figure 20:
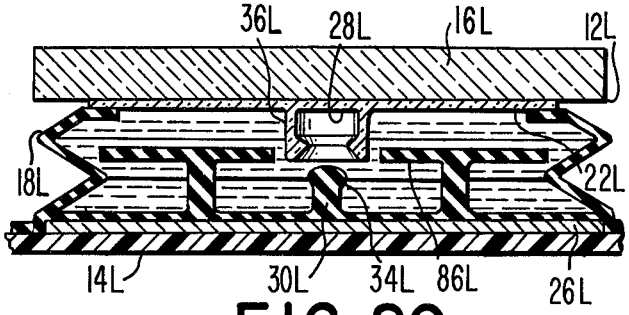
FIG. 20 is a cross section similar to FIG. 4 of yet one more alternative embodiment of the present invention.

In FIG. 20, a keyswitch 12L is shown that includes provisions for both optical indication of the switching state and capacitive or contactless switching. In this embodiment, the cap 16L is formed of a transparent, translucent or other light transmissive material, and from the cap 16L the stem portion 36L depends with the latching recess 28L formed therein. The upper switch half 22L is formed as a layer of conductive material on the bottom surface of the cap 16L, that bottom surface also serving as the top surface of the bag 18L. The lower switch half 26L is formed as two semi-circular plates positioned between the bag 18L and the backing member 14L. The latching member 30L, with the latching mechanism 34L formed thereon, and a raised annular contrast plate 86L are formed upstanding from the inside of the bottom of the bag 18L. The fluid in the bag 18L is, in this embodiment, of a dielectric or insulating nature, and is semi-opaque.

The operation of the keyswitch 12L involves no contact between the switch halves 22L and 26L. When the cap 16L is depressed, the latching recess 28L snaps over the latching mechanism 34L to latch the cap 16L in a depressed position. In this depressed position, the switch half 22L is closer to the switch half 26L than previously, and the effective capacitance between the two plates of the switch half 26L changes significantly. This change can be detected by external circuitry to detent the depression of the keyswitch 12L. Thus contact-free switching is obtained, resulting in a longer switch operating lifetime with only a small increase in the complexity of the external circuitry. The contrast plate 86L of the keyswitch 12L functions similarly to that of FIG. 14, i.e. to reflect a greater amount of light when the keyswitch 12L is depressed than when it is not. For this purpose, of course, the fluid in the bag 18L would again have to be of a semi-opaque, or dimly translucent nature.

Figure 21:
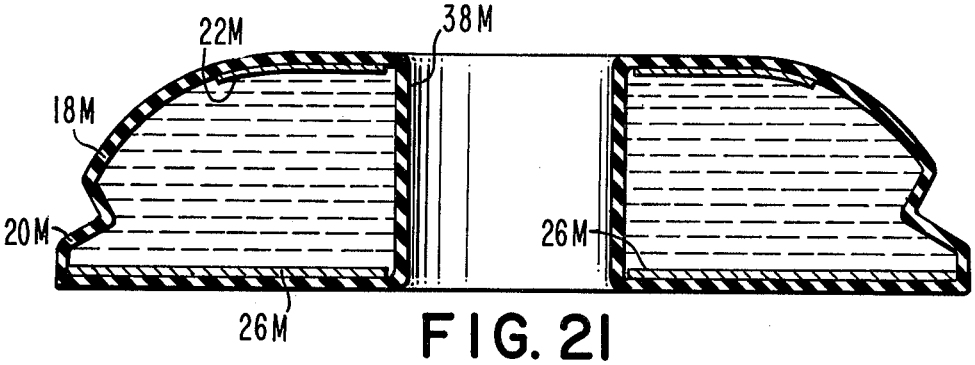
FIG. 21 is a vertical cross section through a bag substitutable for the bag in FIG. 2 to form one more alternative embodiment of the present invention.
Figure 22:
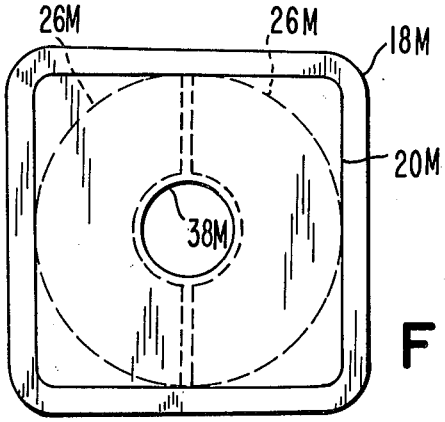
FIG. 22 is a top plan view of the bag of FIG. 21.

Shown in FIGS. 21 and 22 is a fluid filled bag 18M that can be substituted for the bag several of the above embodiments, for example the bag 18 of FIG. 2, to provide contact-free capacitive switching. The upper switch half 22M is formed as an annular plate secured inside the top of the bag 18M and the switch half 26M is formed as two semi-circular plates inside the bottom of the bag 18M. Again the fluid in the bag 18M would be of a dielectric nature.

A keyswitch including the bag 18M of FIGS. 21 and 22 would function electrically similar to the keyswitch 12L of FIG. 20. When the keyswitch was depressed, the perceived capacitance between the two plates of the lower switch half 26M would increase, and the increase would be detected by external circuitry to provide the switching information.

Figure 23:
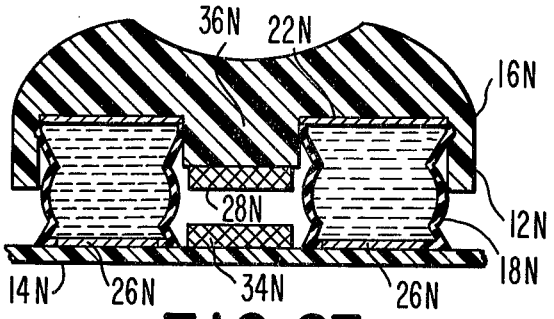
FIG. 23 is a cross section similar to FIG. 4 of another alternative embodiment of the present invention.

Shown in FIG. 23 is a capacitive keyswitch 12N with another alternative latching arrangement. The upper switch half 22N and the lower switch half 26N are again formed as capacitive plates in the bag 18N between the cap 16N and the backing member 14N. In this embodiment no latching recess is provided, but an upper latching mechanism 28N is formed on the stem portion 36N above a lower latching mechanism 34N. Both of the latching mechanisms 28N and 34N are formed as pads of statistical-type fastening material, known commonly as "velcro."

In its operation, the keyswitch 12N provides contactless switching through the capacitance between the switch halves 22N and 26N similarly to the embodiments of FIGS. 20–22. The latching for the keyswitch 12N is provided by the statistical fastening of the upper and lower latching mechanisms 28N and 34N when the cap 16N is depressed, this fastening being released when pressure in the bag 18N increases due to operation of another connected keyswitch.

Figure 24:
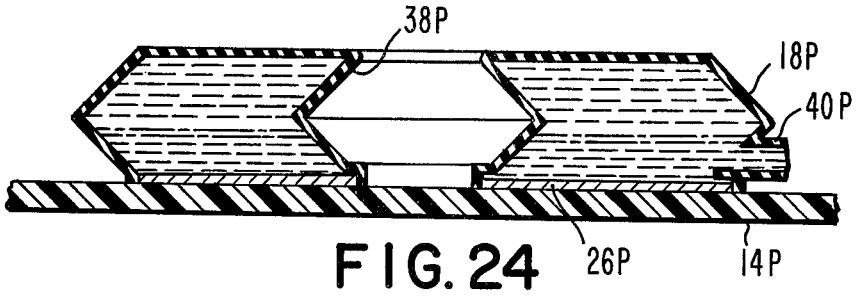
FIG. 24 is a cross section similar to FIG. 21 of a bag for another alternative embodiment of the present invention.

In FIG. 24 a bag 18P is shown for use in a capacitive type keyswitch in which the fluid in the bag 18P is of a non-uniform character. When the bag 18P is not constricted, i.e. the keyswitch of which it is a part is not depressed, the bottom half of the bag 18P is filled with an electrolytic liquid while the top half is filled with a dielectric liquid, the two liquids being immiscible. The bag 18P, as is usual, includes at least one of the coupling tubes 40P connecting to an adjacent keyswitch.

When the keyswitch including the bag 18P is depressed, the bag 18P collapses forcing the electrolytic liquid out of the bag 18P through the coupling tube 40P since it is located in the lower part of the bag 18P. The removal of the electrolyte together with the narrowing of the distance between the switch halves causes a much greater change in capacitance than the closing of the distance between the switch halves would alone.

Figure 25:
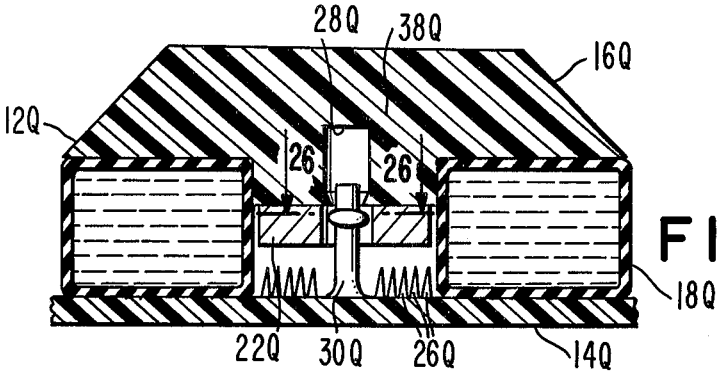
FIG. 25 is a cross section similar to FIG. 4 of yet one more alternate embodiment of the present invention.
Figure 26:
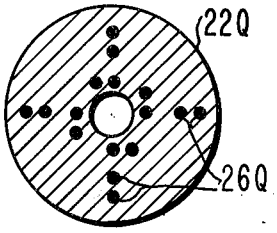
FIG. 26 is a cross section along the line 26—26 in FIG. 25.

FIG. 25 shows a keyswitch 12Q including another method of multiple pole switching. The cap 16Q, the bag 18Q, the backing member 14Q, the latching recess 28Q and the latching member 30Q are similar to those described in several of the above embodiments. In the keyswitch 12Q however, the upper switch half 22Q is formed as an annular disk of semi-conductive material and the lower switch half 26Q is formed as a plurality of upstanding spikes, which are grouped in closely spaced pairs of two. Separate electrical conductors connect each of the spikes to the external circuitry.

In its operation, the depression of the cap 16Q of the keyswitch 12Q of FIG. 25 latches the cap 16Q in a depressed postiion, thereby driving the spikes of the lower switch half 26Q into the semi-conductive disk of the upper switch half 22Q. The semi-conductive nature of the upper switch half 22Q causes the resistance between the spikes that are close together to appear very small while the resistance between the spikes that are spaced further apart appears great. Thus the external circuitry can detect the depression of the keyswitch 12Q by sensing the resistance between two closely adjacent spikes of the switch half 26Q, there being separate sensing circuitry for each pair of spikes. Any possible interference between respective pairs of spikes is minimized by the relatively large spacing between pairs which give rise to a large resistance, and therefore minimum interference, between pairs. In this way switching of a large number of circuits can be accomplished in a single keyswitch.

Figure 27:
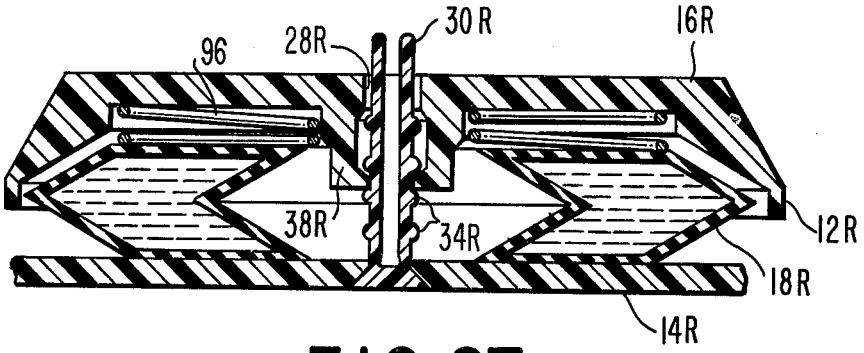
FIG. 27 is a cross section similar to FIG. 4 of an adjustment mechanism for use with the keyswitch pad of FIG. 1.

Shown in FIG. 27 is a dummy keyswitch 12R that is not really a switch at all, but is instead an adjustment mechanism. The dummy keyswitch 12R includes a cap 16R, a fluid filled bag 18R and a backing member 14R similar to those associated with several of the above-described embodiments. In this case, however, the latching member 30R is elongated and bifurcated with a cleft down its center, and has a plurality of the latching mechanisms 34R, in the form of bumps, arranged in spaced pairs along its length. The latching recess 28R extends completely through the cap 16R so the latching member 30R can extend therethrough. A compression spring 95 is positioned underneath the cap 16R between the cap 16R and the bag 18R. No switch mechanisms are included in the dummy keyswitch 12R.

The dummy keyswitch 12R operates as an adjustment mechanism to adjust the pressure of the fluid in the system of interconnected fluid filled bags in the keyswitch pad 10. The bifurcated halves of the latching member 30R can be bought together so that the cap 16R can be moved up or down so as to latch in position at any chosen pair of the latching mechanisms 34R. The pair of latching mechanisms selected determines the allowable volume of the bag 18R, thus adjusting the volume of the interconnected system of bags, to ensure that depression of one keyswitch will de-latch all other keyswitches. The spring 96 provides a positive compressive pressure to keep the fluid in the ststem of bags under pressure so that this is accomplished. The dummy keyswitch 12R thus provides an adjustment mechanism that could be installed on the common backing member in place of a keyswitch, one that is generally compatable with the aesthetic appearance of the keyswitch pad 10, and one that can easily be mounted with the other keyswitches in the pad 10.

Figure 28:
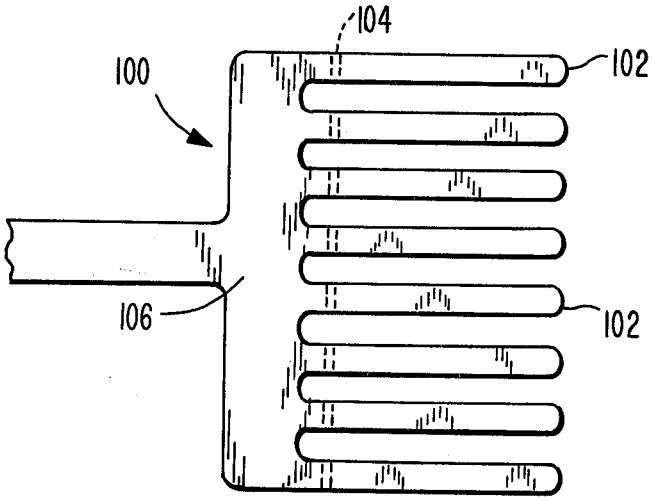
FIG. 28 is a top plan view of an alternative embodiment of an adjustment mechanism usable with the keyswitch pad of FIG. 1.

Shown in FIG. 28 is an alternative adjustment mechanism, generally indicated at 100. The adjustment mechanism 100 includes a series of fingers 102 filled with air or other gas. The boundary between the gas and the other fluid in the fingers 102 is indicated at 104. A manifold 106 connects to the coupling tube 40 of the nearest keyswitch 12 in the keyswitch pad 10. The entire adjusting mechanism 100 is formed of a flexible elastomeric material.

In its operation the adjusting mechanism 100 is also used to adjust the pressure in the system of fluid-filled bags in a keyswitch pad. By providing a roller or pincher mechanism, one or more of the fingers 102 is compressed or pinched, thereby compressing the gas therein. By adjusting the number of the fingers 102 so pinched the pressure on the fluid the system of bags can be adjusted. As was the case with the dummy keyswitch 12R, the adjustment of the fluid pressure serves to ensure that one keyswitch is depressed, the fluid pressure in the bag system will be sufficient to unlatch any other latched keyswitches in the pad 10.

Inasmuch as the foregoing invention is subject to many modification, variations, and changes in detail, it is intended that all the material included in the foregoing specification or in the accompanying drawings be interpreted as illustrative, and not in a limiting sense.

What is claimed is:

1. A keyswitch comprising a backing member, a key cap spaced from but movable toward the backing member, switch contact means arranged between the backing member and the key cap and operated by movement of the key cap, a bag disposed between the key cap and the backing member, said bag having an upward extending portion annularly disposed and concentrically engaging the underneath side of the key cap, and a fluid filling the bag and having a pressure urging the key cap to a raised position.

2. A keyswitch as claimed in claim 1 wherein the bag is of an annular shape with the switch contact means being disposed outside the bag within the center opening of the annulus.

3. A keyswitch as claimed in claim 2 wherein the switch contact means includes an upper switch half mounted on the key cap and a lower switch half mounted on the backing member, switching being accomplished when the key cap moves toward the backing member.

4. A keyswitch as claimed in claim 3 wherein the lower switch half is formed as at least two plated conductive strips on the backing member.

5. A keyswitch as claimed in claim 4 wherein the upper switch half is formed as a conductive cylindrical member with an out-turned annular lip at its lower edge.

6. A keyswitch as claimed in claim 4 wherein the upper switch half includes a ring shaped portion secured to the key cap and at least one pair of switch arms depending from the ring shaped portion.

7. A keyswitch as claimed in claim 6 wherein the lower switch half includes at least one pair of concentric annular contact rings formed on the backing member and wherein a bent contact portion is formed at the end of each depending switch arm.

8. A keyswitch as claimed in claim 4 wherein the upper switch half includes at least two inwardly biased depending switch arms and wherein the lower switch half includes an inner set and an outer set of contacts.

9. A keyswitch as claimed in claim 3 wherein the lower switch half includes at least one pair of staked posts upstanding from the backing member.

10. A keyswitch as claimed in claim 9 wherein the upper switch half is a conductive cylinder.

11. A keyswitch as claimed in claim 3 wherein the upper switch half includes an annular disk of semiconductive material and the lower switch half includes at least one pair of upstanding spikes which penetrate the annular disk when the key cap moves toward the backing member.

12. A keyswitch as claimed in claim 1 wherein the switch contact means is formed inside the bag.

13. A keyswitch as claimed in claim 12 wherein the switch contact means includes an upper switch half mounted in the bag on the key cap and a lower switch half disposed on the backing member.

14. A keyswitch as claimed in claim 13 wherein the key cap includes a stem portion depending therefrom and the bag includes a cup-shaped portion surrounding the stem portion of the key cap.

15. A keyswitch as claimed in claim 14 wherein the upper switch half includes a conductive ring clamping the cup-shaped portion of the bag onto the stem portion of the key cap.

16. A keyswitch as claimed in claim 15 wherein the lower switch half includes at least one pair of posts upstanding from the backing member.

17. A keyswitch as claimed in claim 13 wherein the upper switch half includes a conductive surface formed on the underside of the key cap and the lower switch half includes a pair of plates disposed on the backing member, switching being accomplished by sensing the change in capacitance between the two plates of the lower switch half when the key cap moves toward the backing member.

18. A keyswitch as claimed in claim 17 wherein the fluid in the bag includes two immiscible liquids, one being a dielectric and and one being an electrolyte and wherein a means is provided for the electrolyte to be forced out of the bag when the key cap moves toward the backing member.

19. A keyswitch as claimed in claim 1 further including latching means to latch the key cap in position when it moves toward the backing member.

20. A keyswitch as claimed in claim 19 wherein the latching means includes a latching member upstanding from the backing member with a latching mechanism formed thereon.

21. A keyswitch as claimed in claim 20 wherein the key cap has a latching recess formed therein to engage the latching mechanism on the latching member.

22. The keyswitch as claimed in claim 21 wherein the latching member is a light-emitting diode.

23. A keyswitch as claimed in claim 21 further including a de-latch button, the key cap having a central bore formed therein to receive the de-latch button, depression of the de-latch button serving to widen the latching recess to release the latching mechanism.

24. A keyswitch as claimed in claim 20 wherein the switch contact means includes an upper switch half mounted on the key cap, the upper switch half including at least two depending legs with inwardly bent portions to engage the latching mechanism on the latching member.

25. A keyswitch as claimed in claim 19 wherein the latching means includes statistical fastening means formed on the key cap and on the backing member.

26. A keyswitch as claimed in claim 1 further including optical indicating means to provide a visual signal when the key cap is depressed.

27. A keyswitch as claimed in claim 26 wherein the key cap is formed at least in part of a light transmissive material.

28. A keyswitch as claimed in claim 27 wherein the optical indicating means includes a light-emitting diode.

29. A keyswitch as claimed in claim 27 wherein the optical indicating means includes a contrast plate mounted inside the bag, the fluid in the bag being semi-opaque so the contrast plate is visible when the key cap is depressed.

30. A keyswitch as claimed in claim 1 wherein the fluid in the bag is conductive so as to shield the switch contact means from interference.

31. A keyswitch as claimed in claim 1 wherein the key cap is formed of light transmissive material, wherein the fluid in the bag is semi-opaque, and wherein a contrast plate is positioned in the bag so as to be visible through the key cap and the fluid only when the key cap is moved toward the backing member.

32. A keyswitch pad comprising a backing member at least two keyswitches mounted on the backing member, a key cap in each keyswitch spaced from the backing member, switch contact means in each keyswitch actuated by depression of the key cap, a bag in each keyswitch disposed between the key cap and the backing member, said bags having respective upward extending portions annularly disposed and concentrically engaging the underneath sides of the respective key caps, a fluid filling the bags and having a pressure to urge at least one of the key caps to a raised position, and a coupling tube connecting the bags of each adjacent pair of the keyswitches so that the bags are in fluid communication with each other.

33. A keyswitch pad as claimed in claim 32 wherein the backing member has an adhesive layer on its back surface so the switch pad may be easily installed.

34. A keyswitch pad as claimed in claim 32 further including an adjustment mechanism so the fluid pressure in the interconnected bags may be adjusted.

35. A keyswitch pad as claimed in claim 32 wherein at least one of the keyswitches includes latching means to latch the key cap in position when it is depressed, depression of another keyswitch causing release of the latching means by the fluid pressure in the bag.

36. A keyswitch pad as claimed in claim 32 wherein at least one of the keyswitches includes decoupling gates depending from the key cap to pinch off the coupling tubes connecting to the bag of the keyswitch to prevent depression of the one keyswitch from delatching any other keyswitches.

37. A keyswitch pad as claimed in claim 32 wherein the switch contact means in each keyswitch includes an upper switch half on the key cap and a lower switch half.

38. A keyswitch pad as claimed in claim 37 wherein the backing member is a printed circuit board and wherein each of the lower switch halves is formed by the circuit paths on the printed circuit board.

* * * * *